US005375786A

United States Patent [19]

Ta-Yueh et al.

[11] Patent Number: 5,375,786

[45] Date of Patent: Dec. 27, 1994

[54] WINDING APPARATUS WITH A GUIDANCE DEVICE FOR WIRE OR THE LIKE

[76] Inventors: Hsu Ta-Yueh; Yueh S. Laz, both of Suite 11F, 95-8 Chang Pind Road, Sec. 1,, Taichung, Taiwan, Prov. of China

[21] Appl. No.: 932,291

[22] Filed: Aug. 19, 1992

[51] Int. Cl.[5] ..... B65H 75/48

[52] U.S. Cl. ..... 242/377; 242/397.3; 242/470

[58] Field of Search ..... 242/107, 107.5, 107.6, 242/129.3, 129.62, 158, 157 R, 158.2, 158.3, 86.61; 191/12.2 R, 12.2 A

[56] References Cited

U.S. PATENT DOCUMENTS

| | | | |
|---|---|---|---|
| 2,309,574 | 1/1943 | Busha | 242/107 |
| 2,462,296 | 2/1949 | Yirawa | 242/107 |
| 3,346,705 | 10/1967 | Slinkard et al. | 242/107 |
| 3,578,259 | 5/1971 | Zelnick et al. | 242/107.6 X |
| 4,146,191 | 3/1979 | Caranaugh | 242/107 |
| 4,154,324 | 5/1979 | Upton et al. | 191/12.2 R |
| 4,527,334 | 7/1985 | Jones et al. | 242/107 X |
| 4,542,858 | 9/1985 | Manges | 242/107 X |
| 4,897,512 | 1/1990 | Johnsten | 242/129.62 X |
| 5,117,456 | 5/1992 | Aurness et al. | 242/107 X |
| 5,135,181 | 8/1992 | Wesselink | 242/107.6 X |

FOREIGN PATENT DOCUMENTS

| | | | |
|---|---|---|---|
| 2612627 | 10/1976 | Germany | 242/107 |
| 8700840 | 11/1988 | Netherlands | 242/107 |

*Primary Examiner*—Daniel P. Stodola
*Assistant Examiner*—John P. Darling

[57] ABSTRACT

A winding apparatus with a guidance device comprises a winding drum, a guidance device, and a case. The winding drum can provide spring back force by installing a spiral spring so as to recoil a wire to lap over the winding drum. The guidance device which comprises a driving guide axle, a driven guide axle, and a transmission installation and the winding drum are disposed in the case. The driving and driven guide axles each provides a helical groove spiralling in opposite direction for the guidance of the wire passing through to spirally lap over the winding drum during recoiling. In which, the spring back force of the winding drum during reverse rotation will be transmitted to drive the driving and driven guide axles to rotate in opposite direction by the transmission installation.

2 Claims, 5 Drawing Sheets

WINDING APPARATUS WITH A GUIDANCE DEVICE FOR WIRE OR THE LIKE

BACKGROUND OF THE PRESENT INVENTION

During measuring, gardening, outdoor or indoor decorating and repairing, measuring rule or water tube or electric wire with long length with be required respectively. For measuring rule, if its length is not longer than two to three meters, it can be collected and kept by a winder, as shown in FIG. 1, which the measuring rule 1 is winding about a reel 2 in single ring and lapping over form. Thus, a pull-back spiral spring (not shown in Drawing) can be installed between the reel 2 and one end of the measuring rule 1 to form a conventional flexible rule for automatically recoiling the measuring rule 1 when it is not used.

For wire and the like, such as a water tube, cable, or very long flexible rule,they are always required a very long length for operation. Sometimes, over ten meters long is required. It is difficult for them to be collected in single ring lapping over form because of their huge body size. Conventionally, referring to FIG. 2, long wire or the like 3 is spirally lapping over a winding drum 4 for reducing body size.

The prior method of automatically recoiling a wire or the like, such as the flexible rule, is functioned by the installation of a spiral spring which can make the reel 2 or winding drum 4 to rotate when springing back, but the wire or the like will recoil only in single ring form along with the rotation of the reel 2 or the winding drum 4. That is, the wire will not be automatically lapping over the winding drum 4 spirally which may cause the lapped wire entangled. Hence, the conventional winding drum 4 for long wire or water tube is designed to recoil manually by means of the winding handle 5 provided to the winding drum 4. Therefore, when rewinding manually, the use has to return to the winding drum 4 which may be far way from the operation end of the wire 3 to rotate the handle 5 of the winding drum with one hand and spirally lap and disentangle the wire with the other hand simultaneously and patiently. It is obvious that it requires great effort and consumes a lot of time.

Accordingly, the main object of the present invention is to provide a wire or the like winding apparatus which having a wire winding guidance device to ensure the wire or the like being spirally recoiled orderly.

DRAWING FIGURES

DETAILED DESCRIPTION OF THE PREFERRED EMBODIMENT

Please refer to FIG. 3 to FIG. 6, a winding apparatus comprises a winding drum 10, a guidance device 20, and a case 40.

Figure 1:
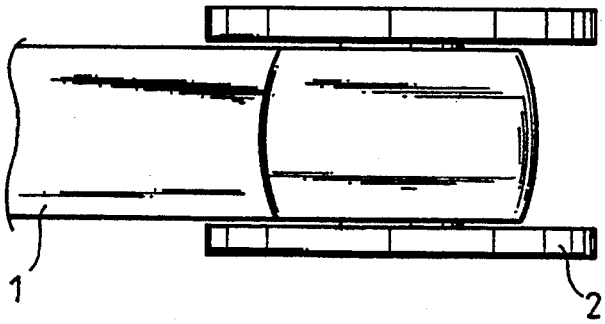
FIG 1 PRIOR ART
FIG. 1 is a front view of a conventional flexible rule.
Figure 2:
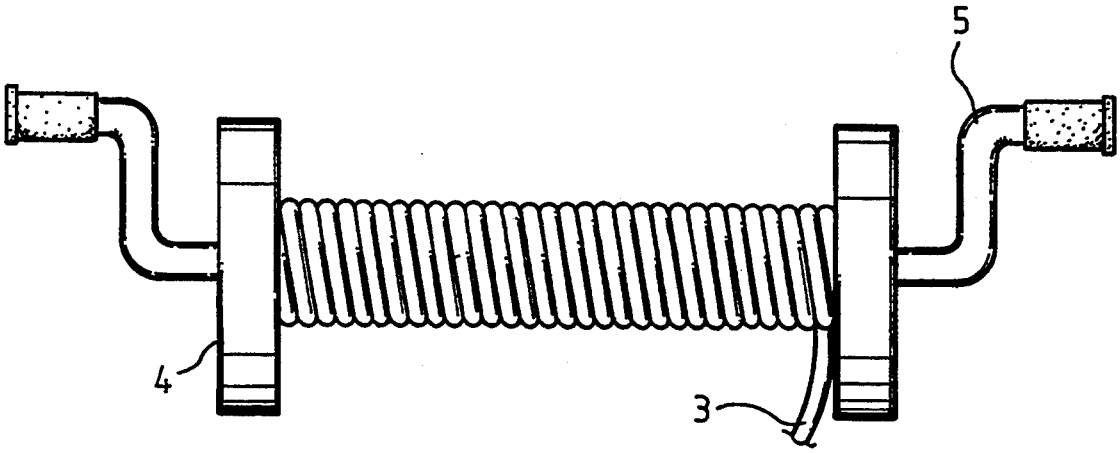
FIG. 2 PRIOR ART
FIG. 2 is a front view of a conventional wire or the like winder.
Figure 3:
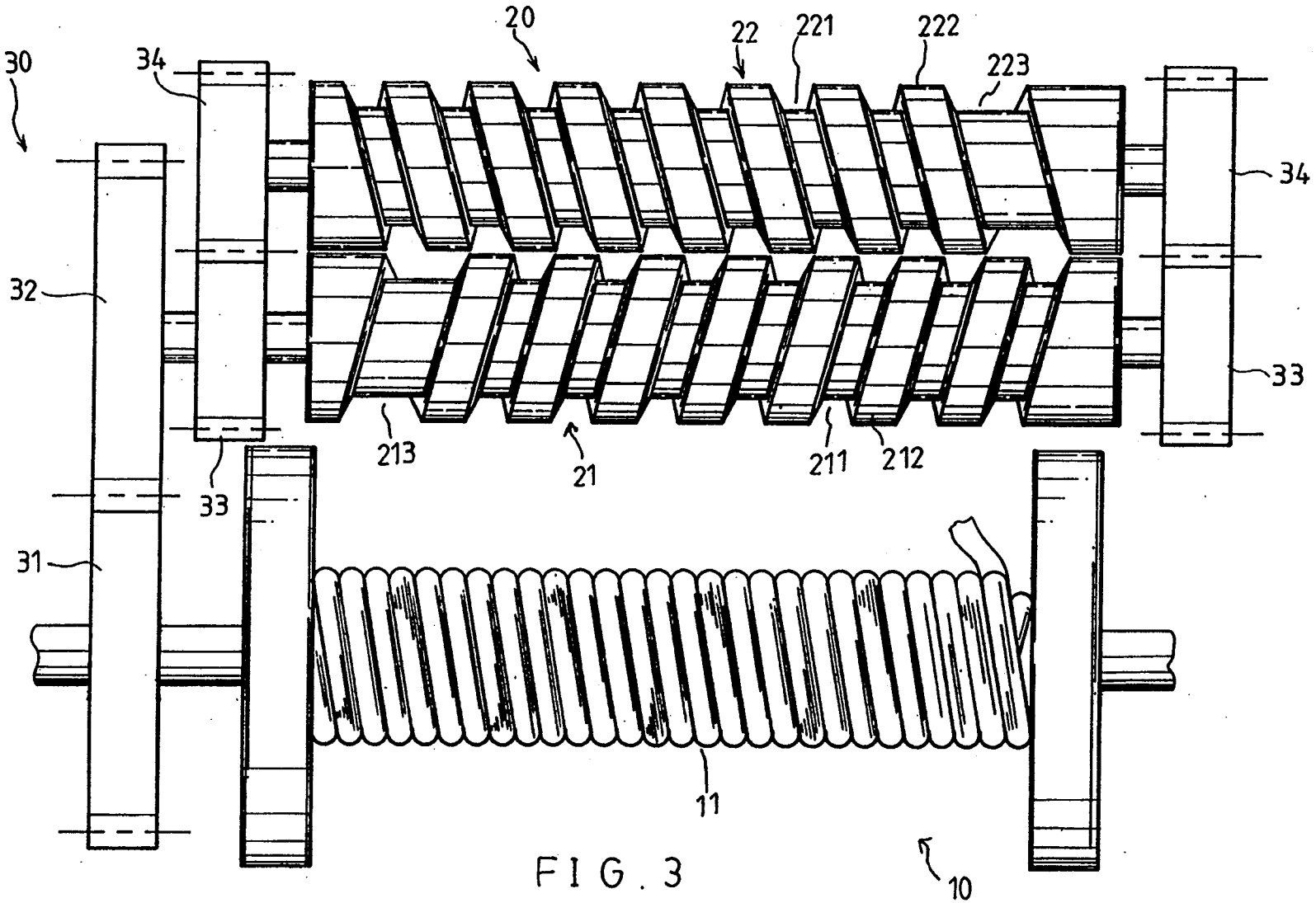
FIG. 3 is a partial front view of a winding apparatus with a guidance device provided of a preferred embodiment according to the present invention.

Referring to FIG. 3, the winding drum 10 can be any conventional form which has installed a spiral spring or other similar element (not shown in Drawing) to provide spring back pulling force in order to automatically recoil a predetermined long wire 11 or the like, such as water tube, cable, or very long rule, etc., which is winded to spirally lapped over the winding drum 10 when the winded off wire is not used.

Figure 4:
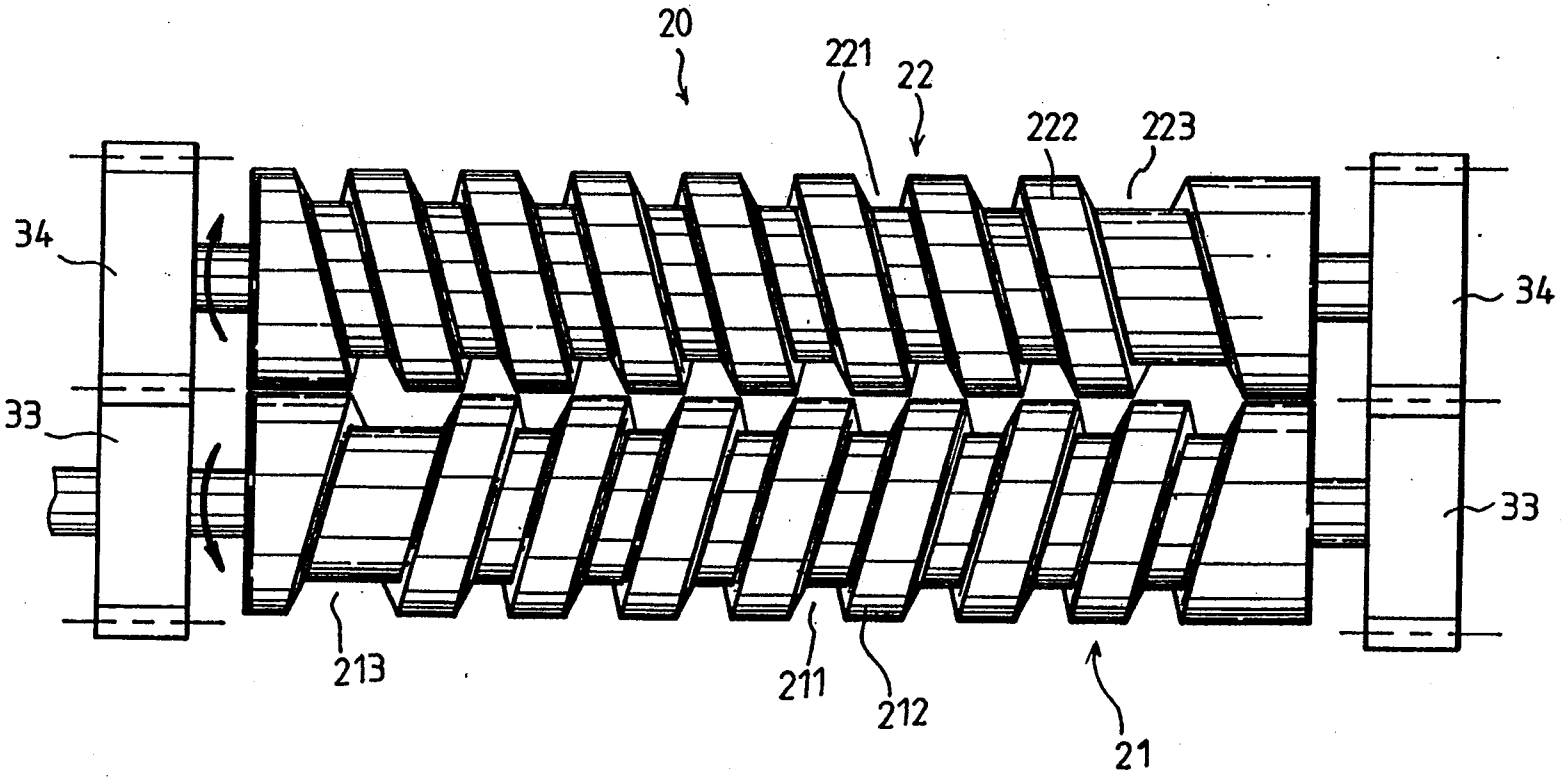
FIG. 4 is a front view of the guidance device of the winding apparatus of the above embodiment according to the present invention.

The guidance device 20, as shown in FIG. 3 and FIG. 4, is disposed next and parallel to the winding drum 10. The guidance device 20 comprises a driving guide axle 21, a driven guide axle 22, and a transmission installation 30 which can transmit the reverse rotating force of the spiral spring of the winding drum 10 to drive the driving guide axle 21 and driven guide axle 22 to rotate in opposite direction simultaneously.

The driving guide axle 21 and the driven guide axle 22 both provide helical grooves 211 and 221 on their circumferential surfaces respectively, but the two helical grooves 211 and 221 are spiralled in opposite directions. The two helical grooves 211 and 221 which are large enough for the wire 11 passing through have the same depth and width and pitch. Of which the helical grooves 211 of the driving guide axle 21 whirls clockwise and the helical groove 221 of the driven guide axle 22 whirls counterclockwise. The driving and driven guide axles 21 and 22 are pivotally disposed next and parallel to each other in the manner that their helical grooves 211 and 221 are just confronted with their correlative crest surfaces 212 and 222 respectively, as shown in FIG. 3. Besides, at one end of the helical groove 211 of the driving guide axle 21 doubles its width to form a reverse end groove 213, while the relative opposite end of helical groove 221 of the driven guide axle 22 is also doubles its width to provide a reverse end groove 223.

Figure 6:
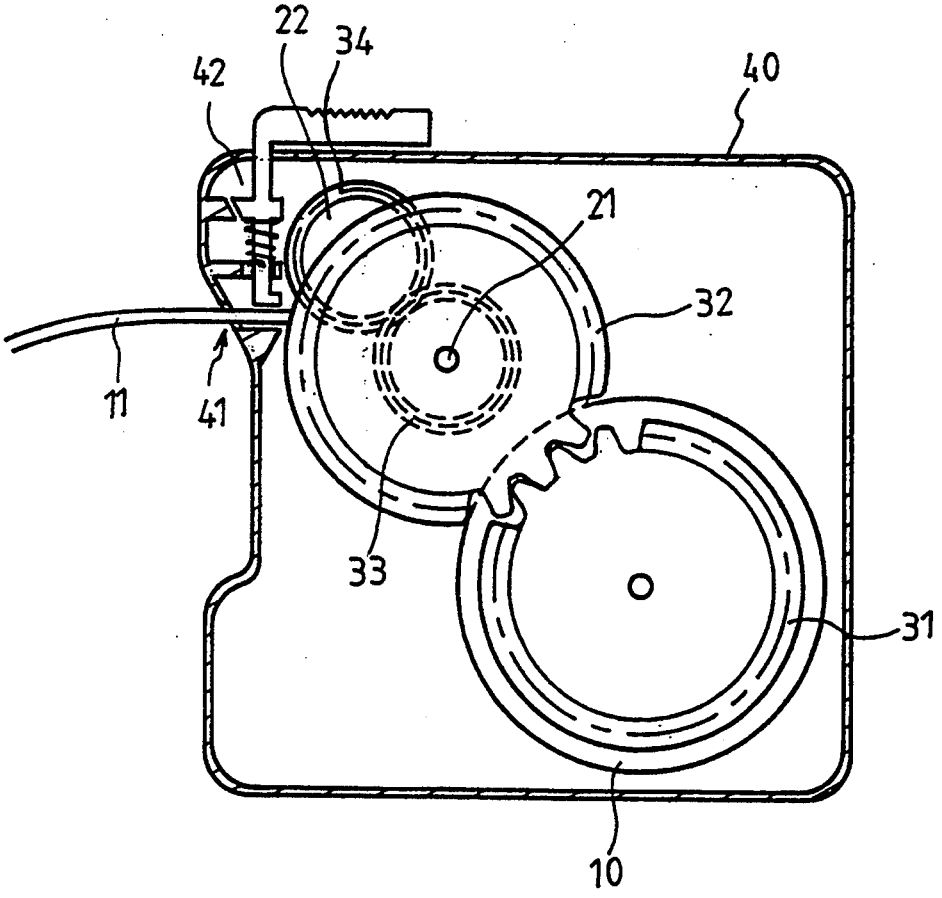
FIG. 6 is an end view of the winding apparatus of the above embodiment according to the present invention.

The transmission installation 30, referring to FIG. 3 and FIG. 6, approximately comprises a main driving gear 31 which is coaxially disposed at one end of the shaft of the winding drum 10; an auxiliary driven gear 32 which having the same number of teeth of the main driving gear 31 is disposed coaxially to one end of the driving guide axle 21 and engaged with the main driving gear 31; a pair of driving gears 33 which are pivotally connected to the two ends of the driving guide axle 21 respectively; a pair of driven gears 34 which are pivotally connected to the two ends of the driving guide axle 22 respectively. The number of teeth of the driving gears 33 and the driven gears are all the same. Hence, when the main driving gear 31 rotates one circle, the auxiliary driven gear 32 and the driving gears 33 with the driving guide axle 21 will be driven to rotate one circle of the same speed. Of course, the driven gears 34 and the driven guide axle 22 will follow to be driven to rotate one circle of the same speed simultaneously.

The case 40 of any conventional form, as shown in FIG. 6, for installing the winding drum 10, wire or the like 11, and the guidance device 20 in appropriative position provides an opening 41 for the wire or the like 11 pulling out or back. Because the opening 41, a pressing lock means 41 of prior known structure is provided to press the wire 11 to stay in position so as to prevent spring-back when predetermined length of wire 11 is pulled out for use.

Figure 5:
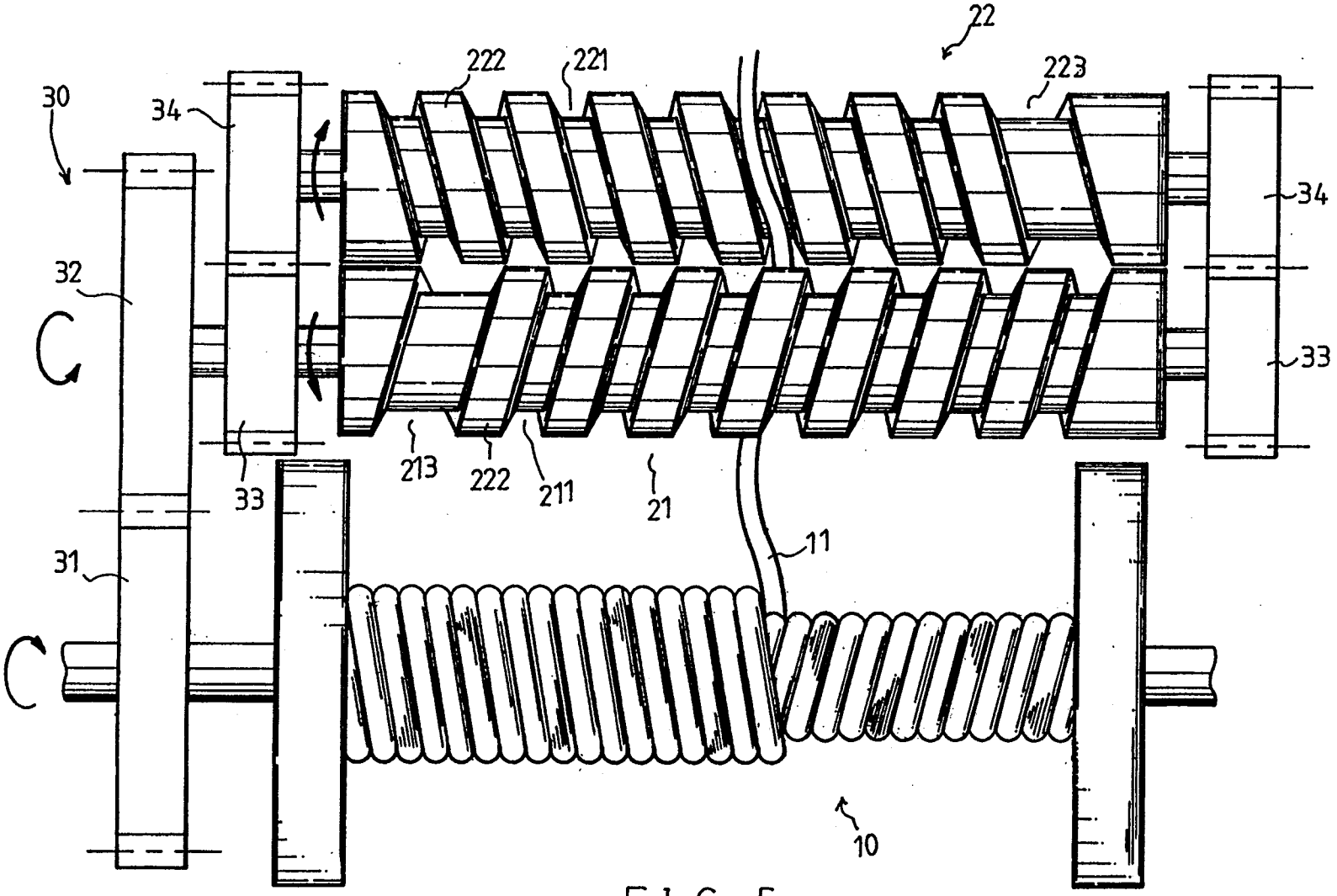
FIG. 5 is a partial front view illustrating the operation of the winding apparatus of the above embodiment according to the present invention.

Referring to FIG. 5 one end of the wire or the like 11 is firmly connected to the winding drum 10, and the other end of the wire 11 is made to pass through the groove 211 or 221 of the guidance device 20 and the opening 41 of the case 40. During recoiling, the winding drum 10 may rotate reversely by means of the spring-back force of the spiral spring (not shown in FIG. 5 and FIG. 6) installed in the winding drum 10 to recoil the wire 11 to lap over the winding drum 10. Thus, the driving guide axle 21 and the driven guide axle 22 will be driven to rotate simultaneously at the same speed. Wire 11 will be pulled back through the helical grooves 211 or 221 to recoil concurrently.

In fact, when the winding drum 10 rotates a circle, the wire will coil a round rightly (as shown in FIG. 5). Simultaneously, the driving guide axle 21 and the driven guide axle 22 will each be driven to rotate a circle in opposite direction. Then the wire 11 passing through the helical groove 221 will be guided to move a pitch distance to right for preparing the next coiling to the winding drum 10. When the wire 11 is brought to move rightly to the reverse end groove 223, the wire 11 will be guided to the helical groove 211 of the driving guide axle 21 inertially. At this moment, the wire 11 is guided to coil spirally to the right end of the winding drum 10. Following to the continuously rewinding of the winding drum 10, the wire 11 will be guided by the helical groove 211 to move lefty pitch by pitch for lapping over the winding drum 10, until it reaches the reverse end grooves 213 and is brought to the helical groove 221 inertially.

Therefore, in accordance with the winding apparatus of the present invention, the wire or the like can be recoiled spirally to lapped over its winding drum or pulling out for use orderly by means of the guiding of a guidance device provided.

I claim:

1. A winding apparatus with a guidance device comprising a winding drum, a guidance apparatus, and a case; in which, said winding drum can provide spring-back pulling force; said winding drum and said guidance device being installed in said case which provides an opening; the improvement wherein:

said guidance device being disposed adjacent and parallel to said winding drum and comprising a driving guide axle, a driven guide axle, and a transmission installation;

the circumferential surfaces of said driving guide axle and said driven guide axle each providing a helical groove respectively, but said two helical grooves of said driving guide axle and said driven guide axle being spiralled in opposite direction; said two helical grooves of said driving guide axle rotating in a first direction and said helical groove of said driven guide axle rotating in a second, opposite, direction;

said driving and driven guide axles being dispose adjacent and parallel to each other in the manner that said helilcal groove of said driving guide axle being disposed opposite a crest surface provided on said driven guide axle and said helical groove of said drive guide axle relatively being disposed opposite a crest surface provided on said driving guide axle; furthermore, at one end of said helical groove of said driving guide axle forming a reverse end having a width twice that of said helical groove; while a relative opposite end of said helical groove of said driven guide axle also providing a reverse end groove having a width twice that of said helical groove; and said transmission installation being disposed in said case for transmitting a reverse rotating force of said winding drum to drive said driving guide axle and said driven guide axle to rotate at the same speed as each other in opposite directions simultaneously; thus, when said winding drum rotating reversely during recoil, said driving guide axle and driven guide axle will be driven to rotate simultaneously in opposition directions at the same speed by means of their said helical grooves.

2. A winding apparatus as claimed in claim 1, wherein said transmission installation comprising a main driving gear coaxially disposed at one end of said winding drum; an auxiliary driven gear which having the same number of teeth of said main driving gear being disposed coaxially to one end of said driving guide axle and engaged with said main driving gear; a pair of driving gears which are connected to two ends of said driving guide axle respectively; a pair of driven gears which are pivotally engaged with said two driving gears respectively, which are disposed on driven guide axle respectively; in which number of the teeth of said driving gears and said driven gears being the same.

* * * * *